US005973596A

United States Patent [19]

French et al.

[11] Patent Number: 5,973,596

[45] Date of Patent: Oct. 26, 1999

[54] GOLF CLUB AND BAG SECURITY SYSTEM

[75] Inventors: John R. French, 3145 Brant St., San Diego, Calif. 92103; Philip Witham, Portland, Oreg.

[73] Assignee: John R. French, San Diego, Calif.

[21] Appl. No.: 09/048,763

[22] Filed: Mar. 26, 1998

Related U.S. Application Data

[60] Provisional application No. 60/042,111, Mar. 26, 1997.

[51] Int. Cl.[6] ..... G08B 13/14

[52] U.S. Cl. ..... 340/568.6; 340/568.1; 340/572.1; 340/571; 206/315.3

[58] Field of Search ..... 340/568, 571, 340/572, 567, 432, 427, 568.1, 568.6, 572.1; 206/315.2, 315.3; 70/64

[56] References Cited

U.S. PATENT DOCUMENTS

| | | | |
|---|---|---|---|
| 4,042,918 | 8/1977 | Klitzman | 340/280 |
| 4,489,314 | 12/1984 | Miller | 340/568 |
| 4,833,456 | 5/1989 | Heller | 340/571 |
| 4,940,966 | 7/1990 | Pettigrew et al. | 340/572 |
| 4,991,413 | 2/1991 | Arnaldo | 340/572 |
| 5,004,100 | 4/1991 | Smith | 206/315.2 |
| 5,028,909 | 7/1991 | Miller | 340/568 |
| 5,041,815 | 8/1991 | Newton | 340/568 |
| 5,126,719 | 6/1992 | DeSorbo | 340/571 |
| 5,392,028 | 2/1995 | Pichl | 340/572 |
| 5,493,274 | 2/1996 | Long | 340/568 |
| 5,565,845 | 10/1996 | Hara | 340/568 |
| 5,589,819 | 12/1996 | Takeda | 340/571 |
| 5,610,585 | 3/1997 | Jobe | 340/568 |
| 5,783,996 | 7/1998 | Muszynski | 340/571 |

*Primary Examiner*—Jeffery A. Hofsass
*Assistant Examiner*—Anh La
*Attorney, Agent, or Firm*—Knobbe, Martens, Olson & Bear LLP

[57] ABSTRACT

One aspect of the invention is directed to a security system for a golf bag with a set of golf clubs. The invention may utilize a small, lightweight control subsystem which is easily mounted on a golfer's existing golf bag to protect both the golf clubs and the bag from theft. In another embodiment, the golf security system may be built into or integrated with a golf bag. The golf security system utilizes the electronic, programmable control subsystem which is designed to prohibit false alarms and senses minute unauthorized changes in the electromagnetic field defined by a detection loop. The control subsystem may include an input device such as a keypad, an electronic key, or other similar input means to arm and disarm the system. In one embodiment, a tag having high magnetic permeability is attached to golf clubs having non-metallic shafts.

28 Claims, 5 Drawing Sheets

GOLF CLUB AND BAG SECURITY SYSTEM

RELATED APPLICATIONS

This application claims the benefit of the filing date of U.S. patent application Ser. No. 60/042,111, filed Mar. 26, 1997, for "Golf Club and Bag Security System" to Witham, et al.

BACKGROUND OF THE INVENTION

1. Field of the Invention

The present invention generally relates to security systems, and more specifically, to systems for security of a golf bag with golf clubs.

2. Description of the Related Technology

The recent dramatic rise in the popularity of golf and the number of golfers, along with the extraordinary increase in the price of clubs and equipment has focused a spotlight on the problem of stolen clubs and bags around the courses of the world. Security is an everyday concern in the current era. Not all golfers can afford to purchase the newest clubs of choice, and not all golfers are trained in the old club-house etiquette which formerly allowed players to leave their clubs unattended without fear of loss. Further, non-golfers often frequent clubs and courses, and some make an active trade in stolen clubs of the most popular brands which are generally unmarked and easily converted to cash.

Although there is no industry-wide data maintained, most professional and amateur golfers have stories about their favorite club or their friend's clubs that were stolen. Despite the prevalence of the problem, however, golfers have not been presented with a viable solution. Previous patents describe devices which are not effective, are too costly to make, or are simply impractical. The problem of stolen clubs and bags therefore persists and continues to grow. What is desired is a small, lightweight alarm which could be easily mounted on a golfer's existing bag or could be built into a golf bag at the time of its manufacture to effectively protect both clubs and the bag from theft.

SUMMARY OF THE INVENTION

The invention may utilize a small, lightweight alarm which is easily mounted on a golfer's existing golf bag to protect both golf clubs and the bag from theft. In another embodiment, the golf security system can be built into or integrated with a golf bag. The golf security system includes an electronic, programmable alarm which is designed to prohibit false alarms but to sense minute unauthorized changes in the electromagnetic field defined by the alarm's detection loop. The alarm system may include a control subsystem with a keypad, a detection loop and a mounting band for mounting on an existing golf bag.

In one embodiment of the present invention there is a golf bag security system, comprising a detection loop arranged around the circumference of a golf bag, a loop oscillator circuit, connected to the detection loop, capable of detecting a change in inductance of the loop, a control circuit identifying an alarm condition in response to the loop oscillator circuit, and an alarm device responsive to the alarm condition. The security system detects and sounds an alarm when the golf bag is moved by at least a predetermined amount.

The system may additionally comprise an arming device enabling or disabling the security system. The system may additionally comprise a tag attached to a golf club, wherein the golf club is located in the golf bag when the security system is enabled. The security system may detect and sound an alarm when an attempt is made to remove the golf club from the golf bag. The tag may comprises a ferromagnetic metal and the tag may have high magnetic permeability. The arming device may be a key, wherein the key is programmable. Alternatively, the arming device may be a keypad, wherein the keypad is used to program a code.

In another embodiment of the present invention there is a method of providing security for a golf bag having a detection loop around its circumference, the method comprising detecting a change in inductance of the loop; and generating an alarm responsive to the change of inductance indicative of a disturbance of the golf bag.

In yet another embodiment of the present invention there is a method of providing security for a golf bag, the method comprising attaching a tag to a golf club; and detecting when the golf club is removed from the golf bag based on the tag.

DETAILED DESCRIPTION OF THE PREFERRED EMBODIMENTS

The following detailed description of the preferred embodiments presents a description of certain specific embodiments to assist in understanding the claims. However, the present invention can be embodied in a multitude of different ways as defined and covered by the claims. Reference is now made to the drawings wherein like numerals refer to like parts throughout.

The detailed description is organized into the following sections: System Overview, Hardware Description, Software Description, User Operation, and Features and Benefits.

System Overview

Figure 1A:
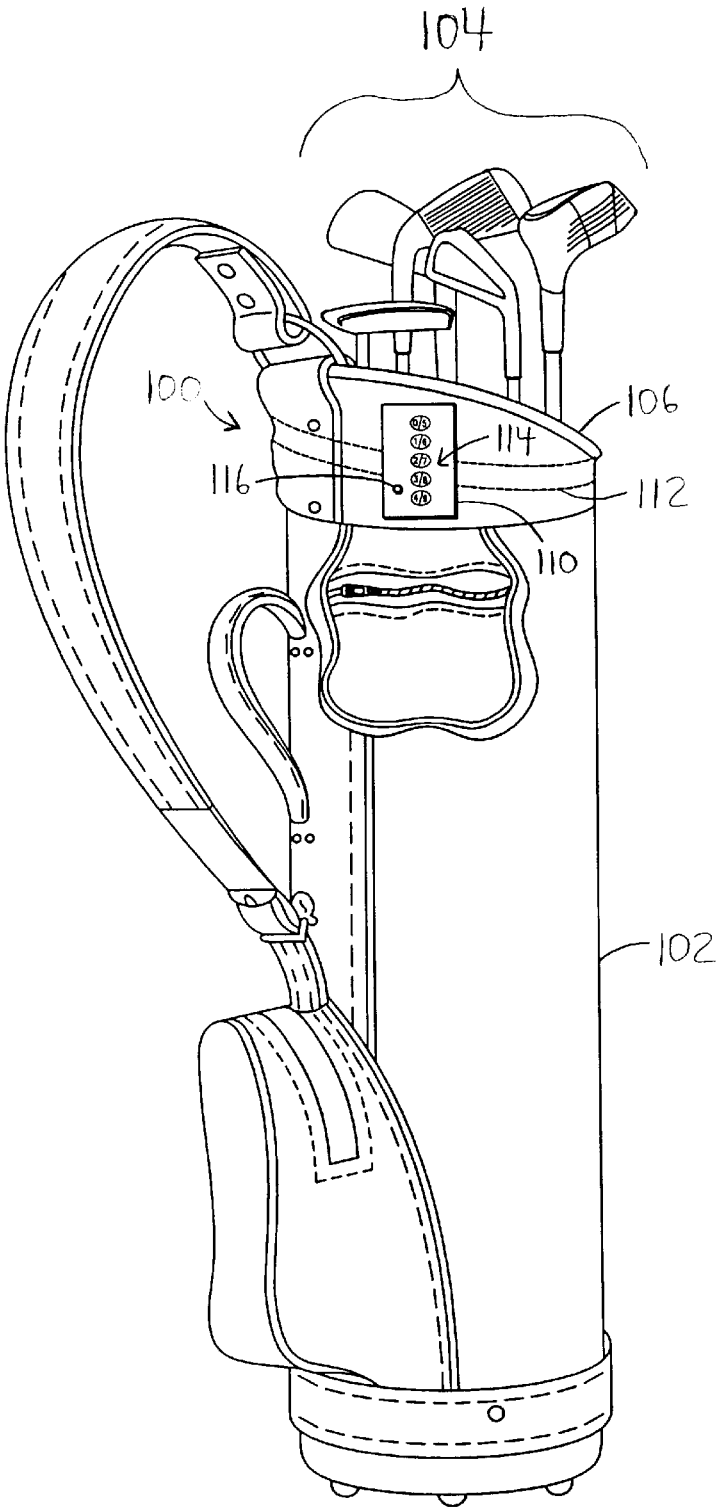
FIG. 1*a* is a diagram showing one embodiment of the golf club and bag security system of the present invention.

Referring to FIG. 1*a*, a golf club and bag security system 100 will be described. The security system 100 is also referred to as an alarm. The alarm 100 includes a control subsystem 110 and a detection loop 112 connected to the control subsystem. In one embodiment, the detection loop 112 is mounted externally around any circumference of a golf bag 102. As shown in FIG. 1*a*, the detection loop 112 may be mounted near the mouth 106 of the bag 102. The control subsystem 110 may be physically located near the mouth 106 of the bag 102, or it may be electrically connected at a location away from the mouth of the bag. A separate strap or mounting band (not shown), which may include a buckle, holds the control subsystem 110 and the detection loop 112 on the bag 102 and also covers and protects the detection loop 112. The strap may be made of an elastic material in which case the buckle is not utilized.

In another embodiment, the control subsystem 110 and the detection loop 112 are built into or integrated in the bag 102 either at the time the bag is manufactured or subsequent to its manufacture but before it is sold to the golfer. In this situation, the detection loop 112 would not be visible to the golfer. As described above, the control subsystem 110 can either be near the mouth 106 of the bag 102, or at a location remote from the mouth.

When the alarm's owner wants to leave his golf bag 102 unattended, while he buys a soda or checks in with the starter, for example, he simply sets the bag 102 down and activates the alarm 100 by entering a personal code on an input device 114 of the control subsystem 110. In one embodiment, the input device 114 may be a keypad. In another embodiment, rather than using the input device 114, the alarm 100 is activated by removing a key (not shown). The alarm 100 works to effectively deter theft in the following three ways: 1) the visible presence of the alarm 100 causes a prospective thief to turn to another target; 2) a blinking LED 116 on the control subsystem 110 signals that the bag 102 is protected; and, 3) an audible alarm signal serves to draw immediate attention to the person who has attempted to remove one or more clubs 104 or the bag 102 from its resting position. When the owner returns to his bag 102, he enters his personal code, or reinserts the security key (in another embodiment), and the alarm is again rendered passive (disarmed).

Hardware Description

Figure 2:
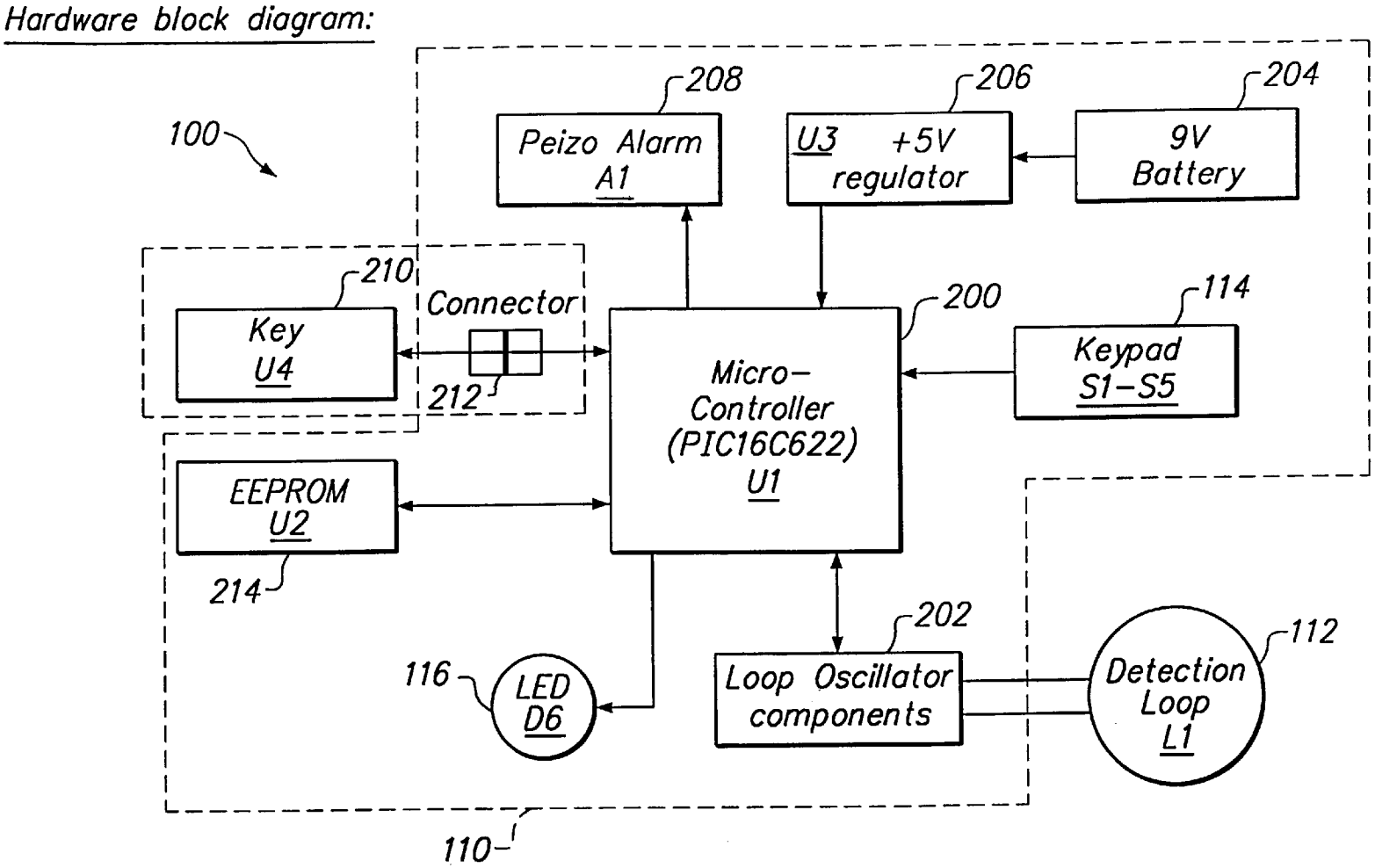
FIG. 2 is a block diagram of the hardware components of the golf club and bag security system shown in FIG. 1*a*.

Referring to FIG. 2, the control subsystem 110 of the security system 100 may, in one embodiment use a Microchip Technology PIC16C622 single-chip microcontroller (U1) 200, also called a "$\mu$P" or PIC here. The microcontroller chip 200 executes about one million instructions per second and performs most of the alarm functions. In one embodiment, the chip 200 includes 2 kbytes of one-time-programmable (OTP) read-only memory (ROM). In another embodiment, the chip 200 includes electrically programmable read-only memory (EPROM) in place of the OTP ROM. The chip 200 also includes 128 bytes of random access memory (RAM), a set of analog comparators, and a watchdog timer. The chip 200 has a sleep mode (4 microAmps supply current) and utilizes less than 2 milliAmps while running.

Figure 1B:
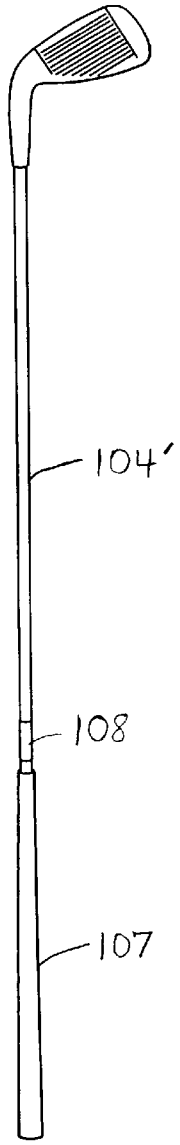
FIG. 1*b* is a diagram of an exemplary golf club with a tag attached for use with the security system of FIG. 1*a*.

A theft condition is detected by an inductive loop (L1) 112 around the golf bag 102 (FIG. 1*a*). The loop 112 is part of an LC resonant oscillator circuit 202, which is further described in conjunction with FIG. 3. A small tag 108 (FIG. 1*b*) may be attached near the handle or grip 107 of a golf club 104' (FIG. 1*b*). In one embodiment, the tag is composed of a high magnetic permeability ferromagnetic metal. A tag 108 is generally necessary for golf clubs having composite shafts, such as graphite, but can be used on all shaft types including metal shafts. Since the permeability of normal steel and other metals is low, a tag 108 may be used on even the metal clubs to make the golf clubs easier to detect. The strong signal from the tag allows the system software to be set to a low sensitivity, thereby preventing false alarms caused by slight movement of the golf bag. Withdrawing the club 104' brings the tag 108 through the loop sensor, effecting its inductance slightly (0.06% or more, for example). Moving the bag 102 by a predetermined amount also shifts the loop 112 itself and changes the loop inductance.

Power is supplied by, for instance, a 9 V battery 204, either lithium or alkaline type. In this embodiment, at least 6 V is required to operate the alarm. Circuit U3 206 is a micropower 5 V regulator with a low battery voltage warning output. The microcontroller 200 will not arm if the battery 204 is at a low voltage. Life expectancy (at 20° C.) of an alkaline battery in this alarm is two years if disarmed, and 340 hours (14 days) when armed. This is approximately one year of use, armed over three hours per week, every week. A lithium battery would last about two to three times as long. Current consumption when disarmed averages 21 $\mu$A, and when armed, 1.43 mA. When the alarm and LED are on, the current consumption is 13.8 mA, mostly into the LED 116.

Certain discrete components such as diodes, resistors, transistors and capacitors are not shown for ease of explanation but will now be described. A set of diodes D1, D2, D3 and D4 protect the $\mu$P chip 200 from electrostatic discharge (ESD). Diode D5 protects the circuit from a reversed-battery condition.

A capacitor C1 prevents an alarm signal from being generated when the microcontroller 200 blips the LED 116 while armed. This is because of the slow speed of the voltage regulator (U3) 206 and the sensitivity of the loop oscillator 202 to power supply voltage.

A pair of resistors R6 and R7 determines the low-battery warning threshold, which is sensed with a transistor Q2 turned on (in other words, when the LED is turned on). Transistor Q2's $VCE_{sat}$ is about 15 mV.

A transistor Q1 drives a piezoelectric beeper element A1 208. The circuit around transistor Q1 forms a symmetrically slew-limited driver, which reduces the noise introduced to the power supply when the beeper 208 is going. Q1 is driven by a software generated square wave.

Switches S1 through S5 are the five-button keyboard or keypad 114 for code entry. When the alarm signal is activated, no combination of simultaneously pressed buttons will silence the alarm signal.

A circuit U4, in the plug-in key 210, is, in one embodiment, a "Silicon Serial Number" chip available from Dallas Semiconductor. Each circuit has a guaranteed unique 48-bit serial number, of which the control subsystem 110 uses 32 bits. The number of possible alarm key serial numbers is thus over four billion. The $\mu$P 200 communicates with the key 210 through a one-wire serial interface. The key 210 plugs into a connector 212 to establish the connection with the microcontroller 200.

A circuit U2 is a 128-byte electrically erasable programmable read-only memory (EEPROM). The $\mu$P 200 communicates with EEPROM 214 by a well-known two-wire serial interface known as $I^2C$. The EEPROM 214 stores the user's four-digit code and 32 bits of the plug-in key's serial number. The number of possible four-digit user codes is 625.

A circuit X1 is the clock crystal for the microcontroller 200. The circuit X1 is a quartz crystal rather than a ceramic resonator for temperature stability (needed by the loop sensor 202).

Figure 3:
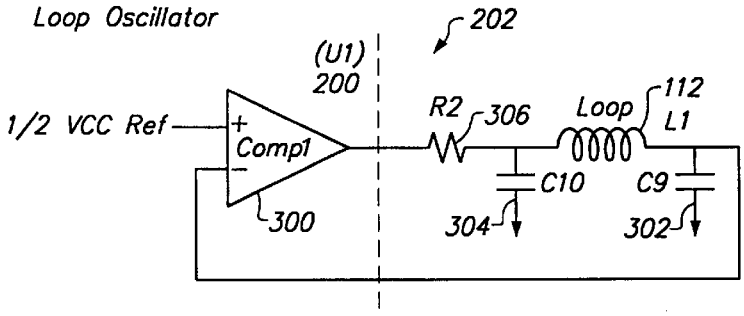
FIG. 3 is a block diagram of the loop oscillator portion of the security system shown in FIG. 2.

Referring to FIG. 3, the detection loop 112 is part of the LC resonant oscillator circuit 202, and a change in inductance affects the frequency of this "loop oscillator". The loop 112 itself is preferably sixteen turns made of a single wrap of ribbon cable.

The loop oscillator (FIG. 3) is formed by using a comparator 300 which is one of the built-in comparators of the microcontroller 200. The DC voltage on capacitors C9 302, C10 304, and the loop 112 is 2.5 V. The AC voltages at C9 302 and C10 304 are at 180° from each other, on opposite sides of the resonant circuit. The signal on the loop 112 is a clean sine wave, 150 mV RMS or so (above 40 mV p-p) at 50–65 KHz (depending on the diameter of the golf bag 102 that the loop is attached to). A resistor R2 306 sets this signal level. The PIC 200 also contains the reference voltage source used by the comparator 300. The output of the comparator 300 is available to the PIC's software directly, and also generates an interrupt to the microcontroller for precise timing of the oscillator frequency.

The metalized polypropylene capacitors C9 302 and C10 304 are paralleled by a pair of capacitors C11 and C12, which are metalized polyester types. This mix balances the temperature coefficient of the capacitors to near zero over a 0° C. to 40° C. range. Otherwise, changing temperature would set off the alarm. The capacitor pairs should be located adjacent to each other on a printed circuit board (PCB), which is part of the control subsystem 110, to keep them both at the same temperature.

The components comprising one embodiment of the security system are listed in Table 1 below:

TABLE 1

| Designation | Description | Mfg. Part # |
|---|---|---|
| U1 | Microprocessor, Microchip Technology | PIC16C622-04/P (OTP) PIC16C622/JW (EPROM) |
| U2 | EEPROM | 24LC01B/P |
| U3 | Voltage regulator | Maxim MAX666CPA |
| U4 | Serial number IC | Dallas DS2401 |
| Q1, 2 | NPN transistor | Zetex ZTX689B |
| D1–5 | G.P. diodes | IN4004 |
| D6 | Red high-efficiency LED, T-1 diffused | Liteon LT1035 |
| D7 | Key ESD protection Zener diode | 1N5232 |
| R1 | 4.7KΩ 5% 1/8 W CF | Any |
| R2 | 3.3KΩ 5% | " |
| R3 | 220Ω 5% | " |
| R4 | 680Ω 5% | " |
| R5 | 30KΩ 5% | " |
| R8, R9 | 22KΩ 5% | " |
| R10 | 6.8KΩ 5% | " |
| R6 | 267KΩ 1% | " |
| R7 | 1 MegΩ 1% | " |
| C1 | 100 μF 10 V Aluminum 85C Low leakage (<3 μ Amax @ 9 V) | Panasonic ECE-A10Z100 |
| C2 | 6.8 μF 6.3 V Tantalum | Any |
| C3 | Not stuffed | |
| C4 | 1 nF Ceramic Monolythic | " |
| C5, 6 | .01 μF Ceramic Monolythic | " |
| C7, 8 | 8.2 pF Ceramic Monolythic | " |
| C9, 10 | .1 μF Metalized Polypropylene Film, 2% | Panasonic ECQ-P1H104GZ |
| C11, 12 | 27 nF Metalized Polyester Film, 5% | Panasonic ECQ-V1H273JL |
| X1 | 4 Mhz HC-49/US crystal | ECS-40-20-4 |
| J1 | Key socket | CUI Stack PJ-003B |
| P1 | Key plug | CUI Stack PP-002B |
| S1–5 | Custom keypad and overlay | |
| A1 | Peizoelectric alarm, self-driving | Panasonic EFB-RL28C11 |
| B1 | 9 V alkaline | Any |
| B1 clip | Battery clip | " |
| Loop | 16 Conductor, Ribbon cable, gray, 30", with DIP headers | " |
| Loop | Strain relief straps, two each | " |
| Box | Custom | |
| PCB | Custom | |
| Club Labels | 0.8 mil METGLAS or equivalent, 3 $in^2$ × 20 | Amuneal Corp. Hi-Mu 80 or AlliedSignal Corp. METGLAS 2705M |
| Back Label | Misc. Info, custom | |

Software Description

Figure 4:
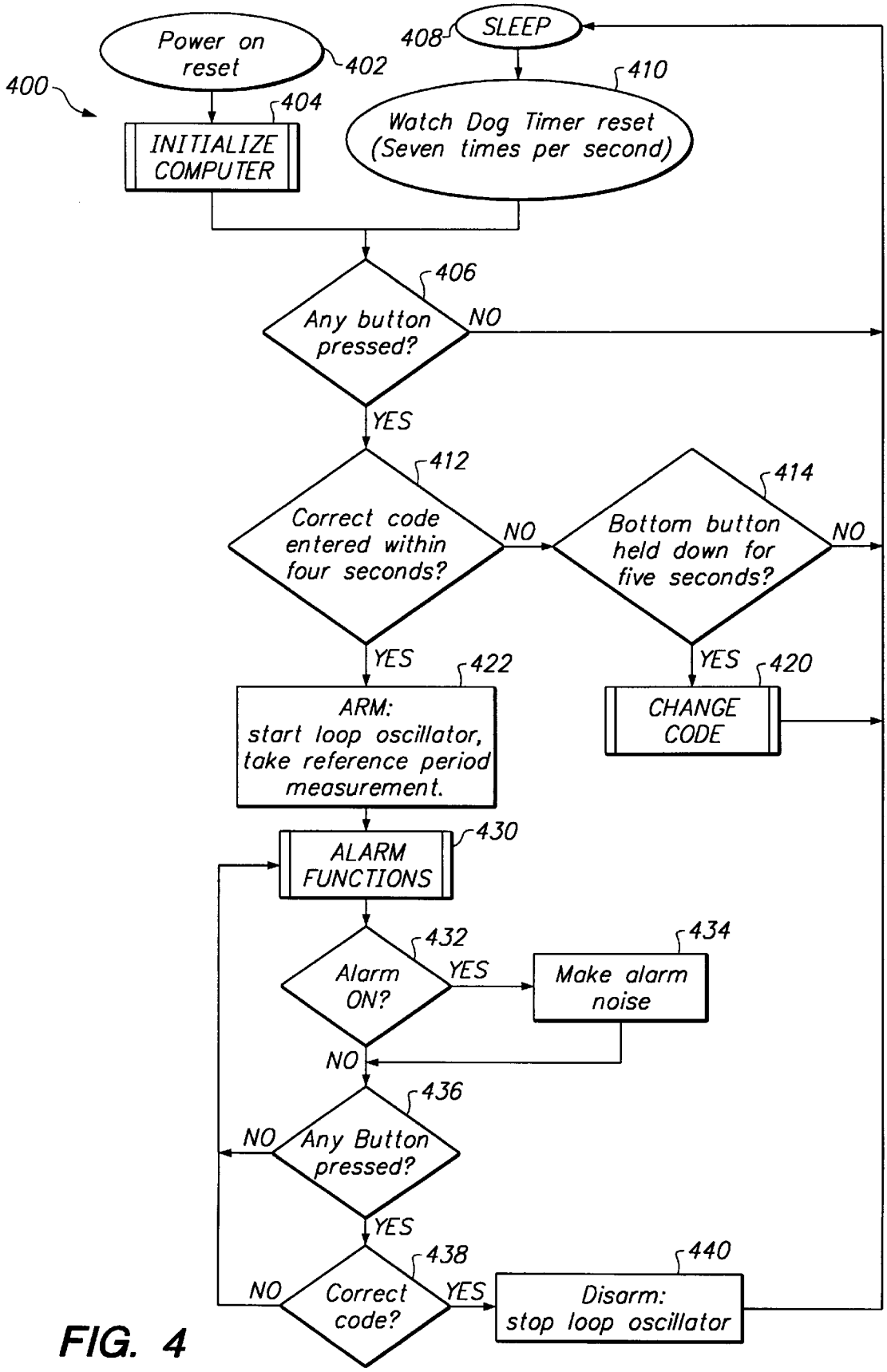
FIG. 4 is a flowchart of the top-level security process performed by the system of FIG. 2.

Referring to FIG. 4, one embodiment of the top-level flow process 400 of the software executed by the microcontroller 200 (FIG. 2) will now be described. The system software is written in Assembly language. One advantage of process 400 is that it prevents false alarms. The golfer/user activates or arms their particular security system 100, and the golfer/user controls when the system is activated.

When a battery 204 (FIG. 2) is first inserted into the control subsystem 110, the process 400 enters a power-on reset state 402. Process 402 moves to an Initialize Computer function 404. Function 404 sets the initial conditions for microcontroller 200 and will be further described in conjunction with FIG. 5 below. Proceeding to a decision state 406, process 400 determines if any of the buttons of keypad 114 have been pressed. If not, process 400 continues at a sleep state 408 to wait for a watchdog timer (WDT) to reset at state 410. Use of the sleep state 408 helps prolong the lifetime of the battery 204. In one embodiment, the WDT resets every one seventh of a second.

When the WDT resets at state 410, the microcontroller 200 is woken from the sleep state and process 400 proceeds to decision state 406 again to determine if any button on the keypad 114 has been pressed. It takes about two milliseconds for the microcontroller 200 to wake up and look around. If a button has been pressed, as determined at decision state 406, process 400 proceeds to a decision state 412 to determine if the correct user Personal Code is entered within four seconds after the first button was pressed. In one embodiment, the user Personal Code is a four-digit code number. In another embodiment, the length of time to wait for entry of the Personal Code may be different. If the correct user Personal Code is not entered within the arming delay period, process 400 moves to a decision state 414 to determine if the bottom button (S5) of the keypad 114 has been held down for five seconds. In another embodiment, the particular button held down and/or the length of time that the button is held down may be different. If the bottom button was not held down for five seconds, process 400 continues to the sleep state 408 as described above.

If the bottom button of the keypad 114 has been held down for five seconds, as determined by decision state 414, process 400 advances to a Change Code function 420. Function 420 obtains and stores a new user Personal Code and is further described in conjunction with FIG. 6 below. After the new code is stored, process 400 continues to the sleep state 408 as described above.

Returning to decision state 412, if it has been determined that the correct user Personal Code has been entered within four seconds, process 400 advances to state 422 wherein the security system 100 is armed. The loop oscillator 202 (FIG. 3) is started and a reference period measurement is made and temporarily stored. Process 400 turns on a Vref module (not shown) and a Comparator module (which includes comparator 300, FIG. 3) of the microcontroller 200, and ceases sleeping. After an arming delay of a few seconds, process 400 begins making loop frequency (period) measurements about 100 times per second. The first eight measurements are averaged together and stored as the "reference" period to which subsequent measurements are compared.

Alternatively, in an embodiment that utilizes the key 210 (FIG. 2) ("the key embodiment"), if a button is pressed at state 406, process 400 checks if the key 210 is plugged into the subsystem 110. If so, the system 100 is armed if the top button of keypad 114 is pressed. The key 210 then has to be removed before an arming delay passes. The alarm system 100 can then be disarmed by plugging in the correct key 210.

At the completion of arming the system 100 and taking the reference period measurement at state 422, process 400 moves to an Alarm Functions function 430. Function 430 performs measurements and sets an alarm condition or flag on if the detection loop 212 (FIG. 3) is triggered. Function 430 will be further described in conjunction with FIG. 7 below. Upon return of function 430, process 400 proceeds to a decision state 432 to determine if the alarm condition was set on during function 430. If so, process 400 triggers activation of the peizo alarm 208 to make an alarm noise at state 434. Several sound effects are available for the peizo alarm 208 (which are selected in the sound descriptor), including "upsweep" (steady increase in frequency), "dnsweep" (steady decrease in frequency), "pwin" (pulse width starts narrow and increases), and "pwout" (pulse width starts at 50% and decreases.) A frequency and a pulse width effect can both be done simultaneously, although that would provide a subtle difference from the frequency effect alone.

If the alarm condition was not set, as determined at decision state 432, process 400 continues at a decision state 436 to determine if any button of keypad 114 (FIG. 2) has been pressed. If not, process 400 loops back to function 430 as previously described above. If a button has been pressed, as determined at decision state 436, process 400 advances to a decision state 438 to determine if the correct user Personal Code was entered by the user. If not, process 400 loops back to function 430 as previously described above. If the correct code has been entered, as determined at decision state 438, process 400 moves to state 440 wherein the security system 100 is disarmed and the loop oscillator 202 is stopped. Process 400 then moves back to the sleep state 408 as previously described above.

When armed, the alarm will immediately sound if the sensor is triggered. Disarming is by the same methods as when the alarm is not going off. The alarm and other sounds are generated by software.

When armed, the LED 116 (FIG. 2) is blipped on for 20 ms every two seconds. At the end of this blip, the low battery warning is checked. If it turns up true, the alarm system 100 is disarmed to prevent false alarms.

When disarmed, holding down the bottom button for a number of seconds puts the alarm system into one of two reprogramming modes. If the key embodiment is not utilized when the button is pressed, the "change code" function 420, described above, is started. If the key embodiment is being used and the key (210) is not in when the button is pressed, the "change key" function is started. The "change key" mode waits for the user to enter the current user code number, and then the user plugs in the new key.

Figure 5:
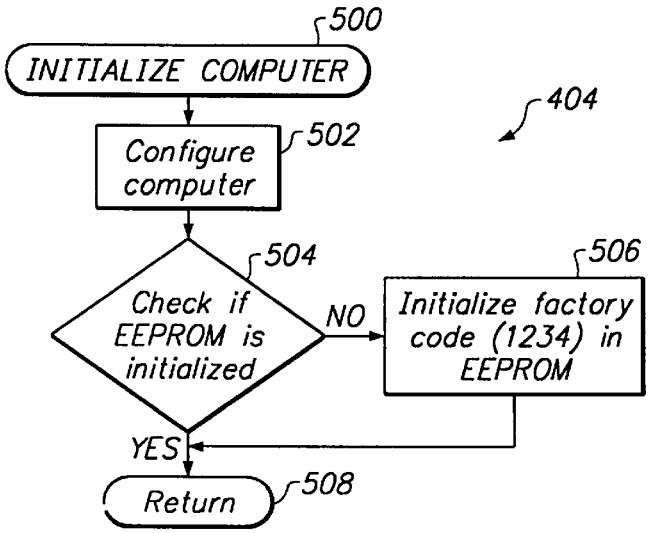
FIG. 5 is a flowchart of the Initialize Computer function shown in FIG. 4.

Referring now to FIG. 5, the Initialize Computer function 404, identified in FIG. 4, will be described. The Initialize Computer function 404 is invoked after a power-on reset. Beginning at a start state 500, process 400 moves to state 502 wherein the microcontroller 200 is configured. The configuration details are well known by practitioners of microcontroller software. Proceeding to a decision state 504, process 400 determines if the EEPROM 214 (FIG. 2) is initialized, i.e., checks to see if the EEPROM has been initialized at the factory yet. If so, function 404 returns at return state 508. An initialized EEPROM is marked with a number that could not be random (e.g., hex 55 AA or binary 0101010110101010). If the mark is not found, as determined at decision state 504, the Personal Code is initialized to "1 2 3 4". The alarm makes a long, complicated tweedling noise rather than just the normal powerup noise when the initialization takes place. At the completion of initializing the factory code at state 506, function 404 returns at return state 508.

In a "key" embodiment, if the mark is not found, as determined at decision state 504, the Personal Code is initialized to "1 2 3 4" and the unique serial number of the key 210 (FIG. 2) currently plugged in is authorized and saved in the EEPROM 214 (FIG. 2). For one key embodiment, if no key is in, no initialization occurs. Initialization will happen on a subsequent power-up if a key is plugged in.

Figure 6:
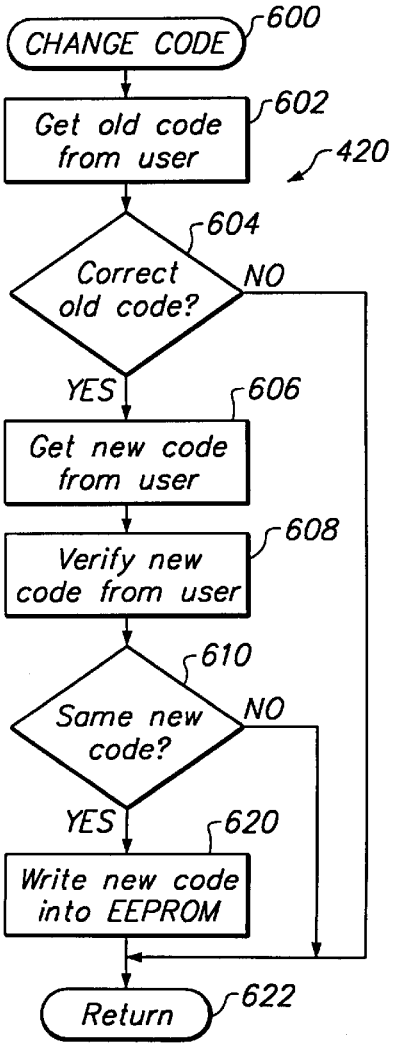
FIG. 6 is a flowchart of the Change Code function shown in FIG. 4.

Referring now to FIG. 6, the Change Code function 420, identified in FIG. 4, will be described. The Change Code function 420 handles changing the existing or old Personal Code to a new Personal Code. In one embodiment, each of the steps through the function 420 is accompanied with a unique sound from the control subsystem 110. Process 420 will time out after waiting a predetermined length of time for user input.

Beginning at a start state 600 of function 420, process 400 to state 602 to obtain the old Personal Code from the user/golfer by use of the input device 114 (FIG. 2). Advancing to a decision state 604, process 400 determines whether the code obtained from the user is correct, i.e., matches the code stored in the EEPROM 214 (FIG. 2). If not, processing of function 420 is terminated and function 420 returns at a return state 622. Thus, in one embodiment, the user needs to enter the correct old code before a new code can be entered.

However, if the correct old code is entered, as determined at decision state 604, process 400 continues at state 606 wherein the user enters a new Personal Code. Proceeding to state 608, process 400 verifies the new code from the user by requesting the user to re-enter the new code on the input device 114. Advancing to a decision state 610, process 400 determines if the second entry of the new code (at state 608) matches the first entry of the new code (at state 606). If not, processing of function 420 is terminated and function 420 returns at the return state 622. The user can then try again to change the code by calling the Change Code function 420 as before (FIG. 4). However, if process 400 determines that the second entry of the new code matches the first entry of the new code at decision state 610, processing continues at state 620 wherein the new Personal Code is stored into the EEPROM 214 (FIG. 2). Function 420 then completes and returns at the return state 622.

Figure 7:
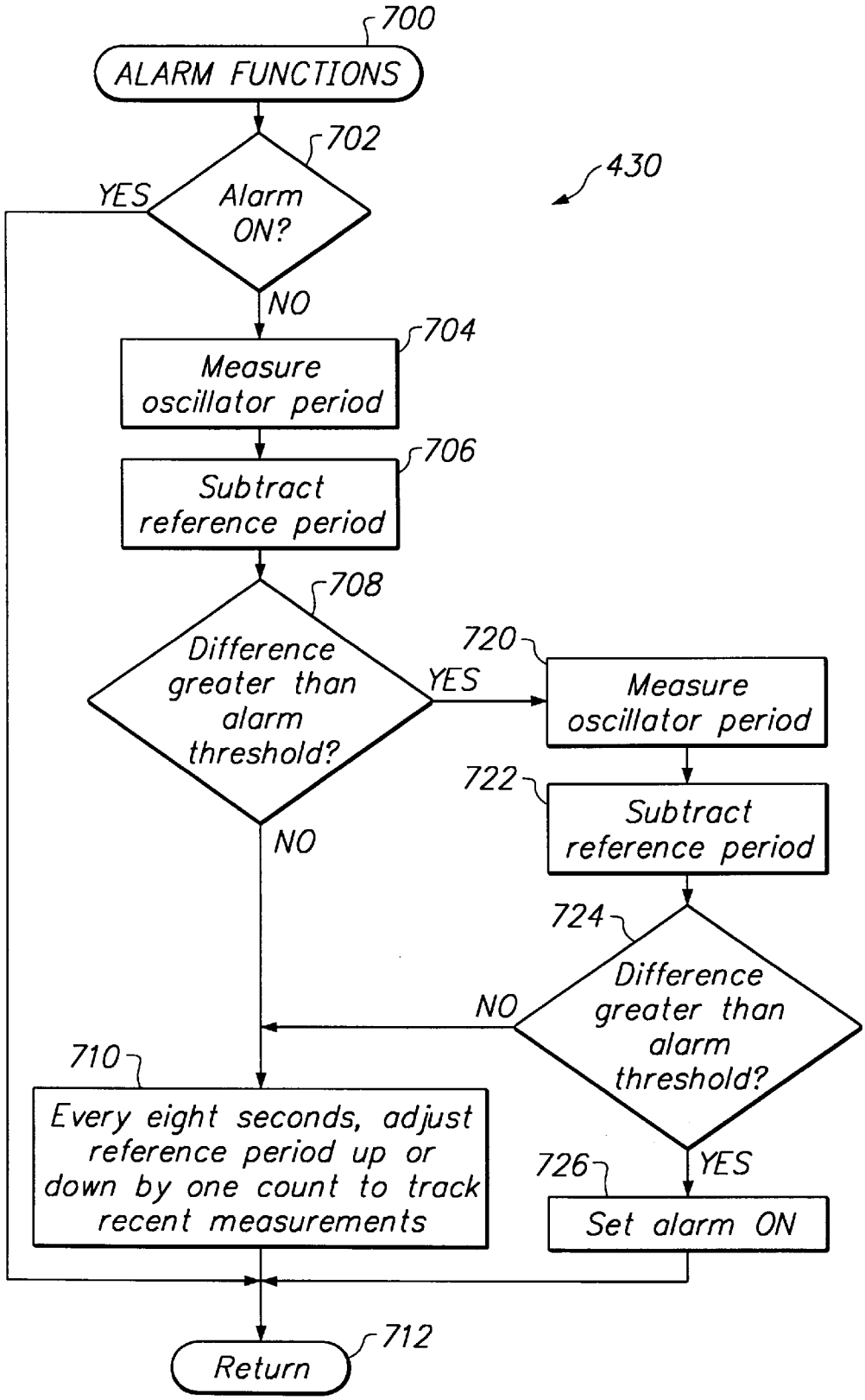
FIG. 7 is a flowchart of the Alarm Functions function shown in FIG. 4.

Referring now to FIG. 7, the Alarm Functions function 430, identified in FIG. 4, will be described. The function 430 is called after the system 100 is armed, the loop oscillator 202 (FIG. 2) is started and a reference period measurement is made.

Beginning at a start state 700 of function 430, process 400 moves to a decision state 702 to determine if the alarm condition (flag) is on (set), such as from a previous execution of function 430. If the alarm condition is on, the alarm condition is left on, processing of function 430 terminates, and function 430 returns at a return state 712. However, if the alarm condition is off, as determined at decision state 702, process 400 proceeds to state 704 to measure the oscillator period.

Most of the time of the microcontroller 200 while armed is utilized to count loop oscillator cycles. Process 400 times the start of an oscillator cycle, then counts a large number of cycles (e.g., 512 cycles in one embodiment), and then times the end of the next cycle. The difference in time between these two measurements ("period") is watched for changes. The timing measurement is in one microsecond units, based on a real time clock register of the microcontroller 200. The 10,000 $\mu$s period measurement is repeatable to $\pm 1$ $\mu$s. Only one byte of period information is measured, the least significant byte (256 $\mu$s range). This procedure works because the system 100 is looking for a small change. Moving to state 706, the period is subtracted from the reference period (obtained at state 422, FIG. 4). The binary math results in a correct difference ("delta") calculation. Process 400 takes the absolute value of the delta.

Proceeding to a decision state 708, process 400 determines if the absolute value of the delta is over an alarm threshold (3 $\mu$s, in one embodiment). If so, process 400 continues to a set of states 720, 722 and 724, which are the same as states 704, 706 and 708 described above. Two period measurements in a row must exceed the threshold to set off the alarm so as to prevent false triggers from electromagnetic interference (EMI), electrostatic discharge (ESD) or so forth. If the absolute value of the delta is over the alarm threshold for the second time, as determined at decision state 724, the alarm condition (flag) is set at state 726 and function 430 returns at the return state 712.

If the absolute value of the delta is not greater than the alarm threshold during the first measurement at decision state 708 or during the second measurement at decision state 724, process 400 moves to state 710 to possibly adjust the reference period. Periodically, to compensate for temperature changes and other such changes, the reference period is bumped up or down by one count to track the ongoing period measurements. Eight measurements are averaged, and the result determines if the reference is changed or left unchanged. In one embodiment, it takes about one minute to make a change of one microsecond in the reference. This rate is set to make it impractical to slowly withdraw a golf club from the bag in an attempt to defeat the system. At the completion of state 710, function 430 returns at the return state 712.

User Operation

The user operation for one embodiment of the system 100, is now described. In the description, it should be noted that the key embodiment may have a primary key and a backup key to be used if the primary key is lost or stolen.

First, there is an initial user set-up after purchase of the security system as follows:

A. Insert a 9 Volt battery per instruction diagram.

B. If the key embodiment is used, leave primary security key in place in control unit, and place the second, back-up key in secure storage at home or other secure location.

C. Initial programming of Personal Code:

1. Hold down bottom button until first tone is heard.
2. Enter a factory code, "1,2,3,4".
3. Enter user Personal Code (4 digits). The Personal Code is any four digit code that the user selects, for example: New Years Eve=1231; or April Fools Day 0401; user's Birthday (mm/dd), and so forth. A tone is heard when the Personal Code is properly entered. Re-enter Personal Code a second time. A tone confirms completion of initial programming sequence.

The following instructions describe two alternative ways of operating the security device where a key is designed and included with the system 100. The first method does not use the security key and the second method incorporates the use of the security key. Instructions for using the security system under normal conditions on the course and at the clubhouse are as follows:

Arming the alarm without the use of a security key:

1. Arming without key: With the key out of the control subsystem or unit, enter the Personal Code. The LED will remain on for several seconds while the alarm waits for the system to settle. After a programmed delay to allow the system to settle, a second tone is heard indicating that the unit is armed, at which time the LED begins to blink.
2. Disarm without key: enter Personal Code; the LED stops blinking and a tone sounds indicating that the unit is disarmed.
3. Alternate Disarm: reinsert key; the LED stops blinking indicating the control subsystem is disarmed.

Alternate operation with the use of a security key:

1. Arming with the security key: press the "Arm" button and pull the security key from the control subsystem. In one embodiment, the Arm button is the top keypad button (S1). The LED will remain on for several seconds while waiting for the system to settle. After the programmed delay to allow the system to settle, a second tone is heard indicating that the control subsystem is armed, and the LED will begin to blink.
2. Disarm: reinsert the key; LED stops blinking and a tone indicates that the unit is "disarmed".

Instructions for reprogramming the alarm in the event the key is lost (for key embodiment) are as follows:

If a golfer loses the primary (first) key, the alarm can still be armed and disarmed using the keypad. However, to prevent misuse by someone else who may have found the particular golfer's key, the particular system must be reprogrammed to accept only the golfer's back-up key. If the lost primary key is later found, the system can be reprogrammed and the primary key used again by performing the following instructions. Programming to use the back-up key simultaneously disables the lost primary key.

1. With the key removed from the control subsystem, hold down the bottom keypad button until the first tone is heard, then release the button.
2. Enter the old (previous) code after which a single, steady tone is heard.
3. Insert the back-up key and operate the system according to the above, normal instructions. The alarm will no longer respond to the lost key unless it is reprogrammed again to recognize and respond to it.

Features and Benefits

This section relates to the features and benefits of the invention. Several of the features and several of the benefits are listed below as follows:

Features

Light-weight, integrated sensor and controls

Simple, inexpensive and reliable electronic design

Programmable

Positive control by owner

Incorporates custom shaft labels

Benefits

Easily installed

Effective security in sleek, miniature package

If key utilized, security ensured even in event of lost key

Prohibits irritating false alarms

Protects both steel and graphite shafts

While the above detailed description has shown, described, and pointed out the fundamental novel features of the invention as applied to various embodiments, it will be understood that various omissions and substitutions and changes in the form and details of the system illustrated may be made by those skilled in the art, without departing from the spirit of the invention.

What is claimed is:

1. A golf bag security system for detecting movement of at least one golf club in a golf bag, the golf bag security system comprising:

a detection loop substantially arranged around the circumference of a golf bag;

a loop oscillator circuit, connected to the detection loop;

a control circuit, capable of detecting a change in inductance in the loop, identifying an alarm condition in response to the change of inductance; and an alarm device responsive to the alarm condition.

2. The system defined in claim 1, wherein the security system detects and sounds an alarm when the golf bag is moved by at least a predetermined amount.

3. The system defined in claim 1, additionally comprising an arming device enabling or disabling the security system.

4. The system defined in claim 3, additionally comprising a tag attached to a golf club, wherein the golf club is located in the golf bag when the security system is enabled.

5. The system defined in claim 4, wherein the security system detects and sounds an alarm when an attempt is made to remove the golf club from the golf bag.

6. The system defined in claim 4, wherein the tag comprises a ferromagnetic metal.

7. The system defined in claim 4, wherein the tag has high magnetic permeability.

8. The system defined in claim 3, wherein the arming device is a key.

9. The system defined in claim 8, wherein the key is programmable.

10. The system defined in claim 3, wherein the arming device is a keypad.

11. The system defined in claim 10, wherein the keypad is used to program a code.

12. A method of providing security for a golf bag having a detection loop arranged substantially around its circumference, the method comprising:

detecting a change in inductance of the loop; and generating an alarm responsive to the change of inductance indicative of a disturbance of one or more golf clubs in the golf bag.

13. The method defined in claim 12, wherein an audio alarm is generated when the golf bag is moved by at least a predetermined amount.

14. The method defined in claim 12, additionally comprising enabling or disabling the generation of the alarm.

15. The method defined in claim 14, wherein a tag is attached to a golf club, and wherein the golf club is located in the golf bag when the enabling is performed.

16. The method defined in claim 15, additionally comprising detecting and sounding an alarm when an attempt is made to remove the golf club from the golf bag.

17. The method defined in claim 15, wherein the tag comprises a ferromagnetic metal.

18. The method defined in claim 15, wherein the tag has high magnetic permeability.

19. The method defined in claim 14, wherein the enabling or disabling utilizes a key.

20. The method defined in claim 19, wherein the key is programmable.

21. The method defined in claim 14, wherein the enabling or disabling utilizes a keypad.

22. The method defined in claim 21, wherein the keypad is used to program a code.

23. A method of providing security for a golf bag having a detection loop substantially arranged around the circumference of the bag, the method comprising:

attaching a tag to a golf club; and changing a frequency in a loop oscillator responsive to a change in inductance of the loop as the golf club is removed from the golf bag.

24. The method defined in claim 23, additionally comprising arming an alarm associated with the golf bag.

25. The method defined in claim 24, wherein the changing is performed if the alarm is armed.

26. The method defined in claim 23, additionally comprising generating an alarm signal if the golf club has been detected to be removed.

27. The method defined in claim 23, wherein the tag comprises a ferromagnetic metal.

28. The method defined in claim 23, wherein the tag has high magnetic permeability.

* * * * *